United States Patent [19]

Twigger

[11] Patent Number: 4,836,333

[45] Date of Patent: Jun. 6, 1989

[54] SUPPORTING ELEMENT

[76] Inventor: Ronald T. Twigger, 19 Adelaide Close, Durrington, Worthing, England

[21] Appl. No.: 182,164

[22] Filed: Apr. 15, 1988

Related U.S. Application Data

[63] Continuation-in-part of Ser. No. 76,042, Jul. 21, 1987, Pat. No. 4,757,877.

[30] Foreign Application Priority Data

Feb. 2, 1988 [GB] United Kingdom ..... 1048192

[51] Int. Cl.[4] ..... B27B 21/00

[52] U.S. Cl. ..... 182/186; 182/226

[58] Field of Search ..... 182/181–186, 182/224–225

[56] References Cited

U.S. PATENT DOCUMENTS

| | | | |
|---|---|---|---|
| 1,153,470 | 9/1915 | Wagner | 182/226 |
| 1,908,858 | 5/1933 | O'Kane | 182/185 |
| 2,416,950 | 3/1947 | Pohrman | 182/186 |
| 3,139,951 | 7/1964 | Clayton | 182/186 |
| 3,212,606 | 10/1965 | Spaw | 182/186 |
| 3,809,183 | 5/1974 | Lowd et al. | 182/186 |
| 4,008,786 | 2/1977 | Canavan | 182/186 |
| 4,134,473 | 1/1979 | Prior | 182/186 |
| 4,248,326 | 2/1981 | Hansen et al. | 182/226 |
| 4,757,877 | 7/1988 | Twigger | 182/186 |

FOREIGN PATENT DOCUMENTS

| | | | |
|---|---|---|---|
| 359872 | 3/1962 | Switzerland | 182/186 |

*Primary Examiner*—Reinaldo P. Machado
*Attorney, Agent, or Firm*—Lon H. Romanski

[57] ABSTRACT

A support element for an end of a board, intended for use in pairs to form a raised working platform or bench, comprises a first upwardly-facing support surface adapted to engage the underside of the board at its end, a second downwardly facing support surface parallel to and spaced vertically from the plane of the first supporting surface by a distance equal to the thickness of the board and spaced horizontally from the first supporting surface to engage the upper surface of the board a predetermined distance from its end, and at least one ground engaging surface so positioned that, in use, the support element engages the ground below the first supporting surface, the upwardly and downwardly facing support surfaces being provided by generally parallel channel-like bars laterally spaced from each other.

12 Claims, 2 Drawing Sheets

6a
4a
4
I
7b
7
5a
5
6
3
2
I 4
9
6
3
T2
8
7b
7a 6a
4a
4
T1
7b
7
7a
6
3

SUPPORTING ELEMENT

RELATED APPLICATION

This application is a continuation-in-part of my pending application Ser. No. 076,042 filed July 21, 1987, for "Supporting Element" and now U.S. Pat. No. 4,757,877.

FIELD OF THE INVENTION

The present invention relates to supporting elements, and is particularly concerned with providing a support for an end of a plank, board or the like on which workmen may stand to work above ground level.

BACKGROUND OF THE INVENTION

It is common practice amongst building operatives to use materials commonly available on building sites to support the ends of a board when working at ceiling level, for example fixing ceiling panels, coving or plastering. Such structures, commonly comprising a plank resting on two oil drums or milk crates, or even on packing cases of disparate height, clearly leave much to be desired as regards the safety of the operatives and much time is lost in firstly the search for appropriate materials and secondly in the repeated need to reassemble the structure at intervals during the work.

The present invention seeks to provide an inexpensive robust and safe support element for a board end, which may be easily assembled to a board of standard width and thickness to provide a safe, raised working platform.

SUMMARY OF THE INVENTION

According to the present invention, a support element for an end of a board or the like comprises a first upwardly-facing support surface adapted to engage the underside of the board at its end, a second downwardly facing support surface parallel to and spaced vertically from the plane of the first supporting surface as by a distance equal to the thickness of the board and spaced horizontally from the first supporting surface to engage the upper surface of the board a predetermined distance from its end, and at least one ground engaging surface so positioned that, in use, the support element engages the ground at a point directly below the first supporting surface, or a point spaced therefrom horizontally in the direction away from the second supporting surface.

In one embodiment of the invention the support element comprises a pair of inclined parallel legs joined at their upper ends by a horizontal plate whose underside constitutes the second supporting surface, each leg having fixed to its side facing the other leg one of a pair of parallel horizontal bars spaced by a predetermined distance from the plate, the bars being joined at one end by an end stop extending in a vertical plane, and the lower ends of the legs terminating in horizontal surfaces either touching or extending through the said vertical plane.

In another embodiment the support element comprises a pair of legs and a pair of elongate channel section bars each having a medial web and a pair of flanges perpendicular thereto, the said bars extending generally horizontally in use with their webs in vertical planes spaced by a distance substantially equal to the width of the board and their flanges in two horizontal planes spaced by a distance substantially equal to the thickness of the board, a transverse end stop positioned between said horizontal planes at one end of the said pair of parallel bars, and said legs extending downwardly from the respective bars, in use, to terminate in, or pass through, a vertical plane transverse to the bars which passes through the end stop, said legs being joined by a transversely extending member positioned intermediate the lengths of the legs.

In yet another alternative, the support element may omit the end stop to allow the support element to be positioned at any point along a board.

To improve the lateral stability of the support element, the legs may be made to diverge downwardly over all or a part of their length, or laterally extending feet may be added on the lower ends of the legs.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE INVENTION

Figures 1, 2, 3:
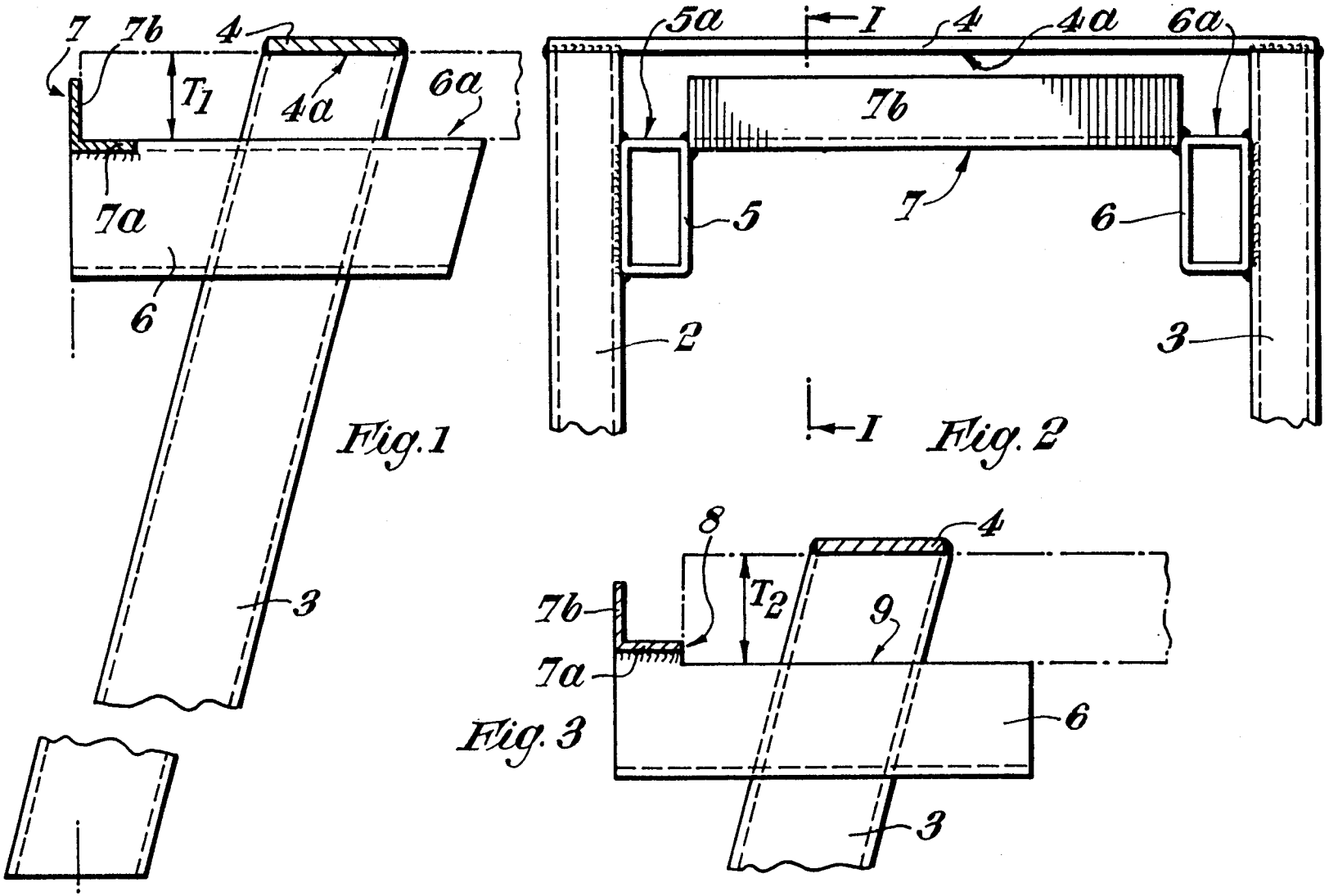
FIG. 1 is a cross-sectional side of a support element, with a portion thereof broken away, in its working position.
FIG. 2 is a fragmentary end view, in elevation, of the support element of FIG. 1.
FIG. 3 is a cross-sectional side view which is similar to a fragmentary portion of FIG. 1, but which depicts a modification thereof.

Referring now in greater detail to the drawings, in FIGS. 1 and 2 the support element 1 is illustrated as comprising two legs 2, 3 joined by a top plate 4 at their upper ends. As will be clear, the legs in use are inclined at approximately 15° to the vertical and the top plate 4 is horizontal. Two bars 5, 6 are fixed to respective facing sides of the legs 2, 3 and extend horizontally out from the legs 2, 3. The upper surfaces 5*a*, 6*a* are spaced by a distance $T_1$ from the underside 4*a* of the top plate 4. An end stop 7 extends between respective ends of the bars 5 and 6, and comprises an angle section having a horizontal flange 7*a* flush with top surfaces 5*a*, 6*a* of bars 5, 6 and a vertical flange 7*b* upstanding therefrom. The legs 2, 3 extend downwardly to terminate with the centre of each leg positioned in the plane of the vertical flange 7*b*.

In use, to erect a working platform a board of thickness $T_1$ is selected, the width of the board being less than or equal to the spacing between the legs 2, 3 of the support element. The board is then simply inserted into the support element between the bars 5, 6 and the top plate 4, until it occupies the position shown in phantom lines in FIG. 1 with the end of the board contacting the vertical flange 7*b* of end stop 7. The upper and lower surfaces of the board abut the underside 4*a* of the top plate 4 and the upper surface of flange *7a* of the end stop 7 and the upper surfaces *5a, 6a* of the bars 5 and 6 respectively.

A second support element is then fitted in a similar way to the other end of the board and the board may then be used as a working platform.

Various features of the invention are worthy of emphasis. Firstly, the top plate 4 extends above the board and will warn an operative working on the board that he is approaching the end of the platform when the operative feels the top plate under his foot. It is a common occurrence with present structures that an operative will simply walk off the end of the board while his attention is devoted to the task in hand.

A second common source of danger is the present practice of siting the support (oil drum, crate etc.) at a point away from the end of the board. The operative may then progress along the board and on to the overhung section, with predictable results. The present support is so constructed that there can never be any overhang of the board past the support and thus this danger is eliminated.

In FIG. 3 there is shown a variant of the support element, in which the upper surfaces *5a, 6a* of the bars 5, 6 are formed with a step 8 and a second, lower horizontal surface 9. It is to be understood that the second surface 9 is at least partially situated between the top plate 4 and the end stop 7. The purpose of this step is to allow the support to accommodate boards of two different thicknesses, the support being used in the manner described above with boards of a first thickness $T_1$, the board end contacting flange *7b* of end stop 7 and flange *7a* abutting the underside of the board. When a board of thickness $T_2$, greater than $T_1$, is used then the end of the board will contact the step 8 and the second surface 9 will engage the underside of the board. If desired, a crosspiece may be provided flush with second surface 9 to extend between the bars 5 and 6, so that boards having a width less than the spacing between bars 5 and 6 may be accommodated. Screw tightening elements may also be provided to grip the sides of the board, if desired.

In order to increase the versatility of the support element, it may be provided with telescopic legs to provide height adjustment. In the embodiment shown, the legs will be arranged so that at the lowest height adjustment the lower extremity of the leg is in the plane of the end stop flange *7b*, and when extended the lower end of the leg will extend beyond this plane. Rubber or other non-slip feet may be provided.

To provide a centre support for use on a longer board, to prevent undue sagging, the two end support elements may be supplemented by a third support element identical to the others, except that the upright flange *7b* is omitted, as is the step 8. Such a support element would be usable only with one thickness of board, but could be positioned at any point along the board to give central support.

The support elements described above are preferably of welded steel construction for durability, but if light weight is a requirement then aluminium or other suitable materials may be used.

Figure 4:
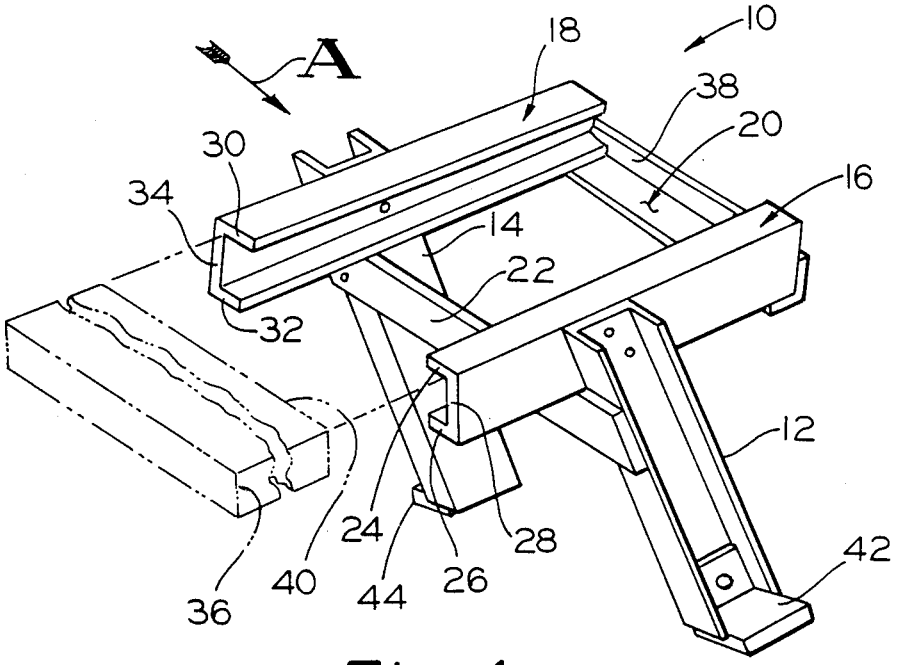
FIG. 4 is a perspective view of another form of the support element.
Figure 6:
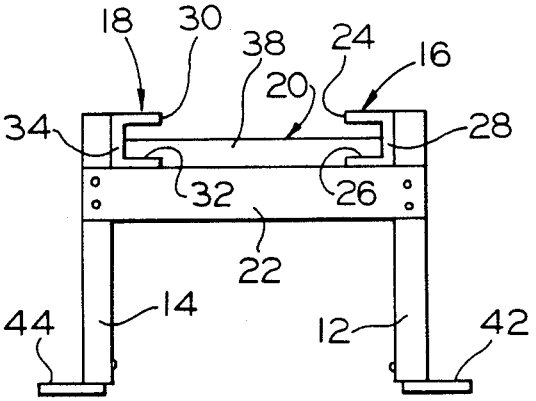
FIG. 6 is an end elevational view taken generally on the plane of line 6—6 of FIG. 5 and looking in the direction of the arrows.
Figure 5:
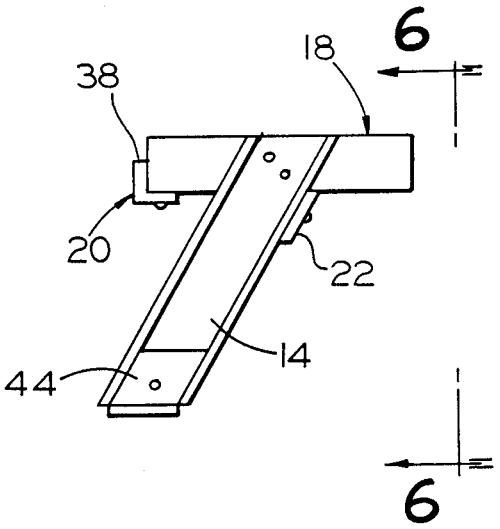
FIG. 5 is a side elevational view of the support element of FIG. 4 taken generally in the direction of the arrow, A, of FIG. 4.

FIGS. 4, 5 and 6 illustrate the support element 10 as comprising a pair of legs 12 and 14 which, similarly to legs 2 and 3 of FIGS. 1, 2 and 3, are fixedly secured to and extend obliquely downwardly from respective ones of a pair of bars 16 and 18. The two bars 16 and 18 are held relative to each other preferably by a first transversely extending member 20, extending as between respective first ends of the bars 16 and 18, and a second transversely extending member 22 suitably fixedly secured at its opposite functional ends to legs 12 and 14 as by, for example, riveting.

In the preferred embodiment of the support element 10, each of the bars 16 and 18 are of channel cross-sectional configuration with bar 16 comprising generally transversely positioned and longitudinally extending upper and lower flange portions 24 and 26 with a longitudinally extending web portion 28 joined to flange portions 24 and 26. Similarly, bar 18 comprises generally transversely positioned and longitudinally extending upper and lower flange portions 30 and 32 with a longitudinally extending web portion 34 joined to flange portions 30 and 32.

As best seen in FIGS. 4 and 6, the support bars 16 and 18 define, in axial end view, a C-like configuration with the respective openings thereof being directed toward each other. The bars 16 and 18 are transversely or laterally spaced from each other as to enable the slidable reception therein, and therebetween, of an end portion of a cooperating board means or platform means as depicted in phantom line at 36. When the platform means 36 is introduced into the support bars 16 and 18, the lower flanges 32 and 26 serve to provide upwardly facing support surfaces for engagement with the underside of the board or platform means 36 while the upper flanges 30 and 24 serve to provide downwardly facing support surface means for engagement with the upper surface of the board or platform means 36. The web portions 28 and 34, of course, are spaced from each other as to confine the sides of the platform means 36 therebetween and may be considered as lateral abutment means for limiting the lateral movement of the platform means 36 relative to the support element 10.

In the preferred embodiment of the support element 10, a longitudinal abutment is provided as to determine the maximum longitudinal movement of the platform means 36, relative to support element 10, when the end of the platform means 36 is being inserted into support bars 16 and 18. If such is to be employed, the longitudinal or end abutment 38 may be carried by the transverse member 20 and, in fact, may be integrally formed therewith. As best seen in both FIGS. 4 and 6, the end abutment means 38 is situated as to be in the general path of movement of the platform means 36 as the platform means 36 is received within support bars 16 and 18.

In use, the board or platform means 36, having a width preferably closely approaching the lateral spacing between the side abutment means or webs 28 and 34 and a thickness preferably closely approaching the vertical distance between flanges 30 and 32 or 24 and 26, is positioned within and between horizontal support bars 16 and 18 with the end 40, of platform means 36, abutting against the end abutment means 38. A second support element 10 is then applied to the other end portion of the same platform means 36 to form a stable raised working platform.

Preferably, the lower ends of legs 12 and 14 are respectively provided with generally outwardly extending feet which may be respectively formed of angle plates 42 and 44 fixedly secured, as by for example riveting, to the webs of legs 12 and 14.

Further, in the preferred embodiment of the support element 10 of FIGS. 4–6, the lower ends of the legs 12 and 14, with or without the feet 42 and 44, terminate in horizontal surfaces either touching or extending through a vertical plane passing as through the abutment surface means of end stop means 38.

In comparing the structures of FIGS. 1–3 to that of FIGS. 4–6, it can be seen that there is a degree of functional similarity.

For example, the support bars 5 and 6 of FIGS. 1 and 2 at least some extent resemble the support bars 16 and 18 of FIGS. 4–6. The difference is that the upwardly directed support surfaces, for operatively engaging the underside of the board, in FIGS. 1 and 2 are provided by the lateral surfaces (or sides) 5*a* and 6*a* formed at the tops of bars 5 and 6, respectively, while in the embodiment of FIGS. 4–6 such upwardly directed support surfaces are provided by lateral surfaces of flanges 26 and 32 formed at the bottoms of bars 16 and 18. Further, in the embodiment of FIGS. 1 and 2, the downwardly facing support surface, for operatively engaging the upper surface of the board or platform means, is provided by the underside 4*a* of transverse member 4, while in the embodiment of FIGS. 4–6 such downwardly facing support surface means is provided by the lateral surfaces of flanges 24 and 30 formed at the tops of bars 16 and 18.

Although only a preferred embodiment and selected modifications of the invention have been disclosed and described it is apparent that other embodiments and modifications of the invention are possible within the scope of the appended claims.

What is claimed is:

1. A support element for an end of an elongate board or the like, comprising a pair of legs and a pair of elongate channel-section bars each having a medial web and a pair of flanges perpendicular thereto, the said bars extending generally horizontally in use with their webs in vertical planes spaced by a distance substantially equal to the width of the board and their flanges in two horizontal planes spaced by a distance substantially equal to the thickness of the board, a transverse end stop positioned between said horizontal planes at one end of the said pair of parallel bars, and said legs extending downwardly from the respective bars, in use, to terminate in, or pass through, a vertical plane transverse to the bars which passes through the end stop, said legs being joined by a transversely extending member positioned intermediate the lengths of the legs.

2. A support element according to claim 1, wherein the legs extend obliquely downwardly from points intermediate the lengths of the respective channel-section bars.

3. A support element according to claim 1, wherein the legs are provided at their lower ends with laterally outwardly extending feet.

4. A support element according to claim 1, wherein said end stop comprises an angle section having a horizontal flange and a vertical flange, the horizontal flange being fixed at its respective ends to one of the flanges of each of the channel-section bars.

5. A support element according to claim 1 wherein the legs extend obliquely downwardly from points intermediate the lengths of the respective channel-section bars, and wherein the legs are provided at their lower ends with laterally outwardly extending feet.

6. A support element according to claim 1 wherein the legs extend obliquely downwardly from points intermediate the lengths of the respective channel-section bars, and wherein the said end stop comprises an angle section having a horizontal flange and a vertical flange, the horizontal flange being fixed at its respective ends to one of the flanges of each of the channel-section bars.

7. A support element according to claim 1 wherein the legs are provided at their lower ends with laterally outwardly extending feet, and wherein said end stop comprises an angle section having a horizontal flange and a vertical flange, the horizontal flange being fixed at its respective ends to one of the flanges of each of the channel-section bars.

8. A support element according to claim 1 wherein the legs extend obliquely downwardly from points intermediate the lengths of the respective channel-section bars, wherein the legs are provided at their lower ends with laterally outwardly extending feet, and wherein said end stop comprises an angle section having a horizontal flange and a vertical flange, the horizontal flange being fixed at its respective ends to one of the flanges of each of the channel-section bars.

9. A support element for an elongate board or the like, comprising first upwardly facing support surface means adapted to engage an underside of the board along its end portion, second downwardly facing support surface means parallel to and spaced vertically from the plane of said first supporting surface means by a distance sufficient to accommodate the thickness of the board and effective to engage an upper surface of the board, and at least one ground engaging surface so positioned that in use the support element engages the ground below the first supporting surface means, wherein a pair of legs are joined to each other by a transversely extending member, each of said legs having one of a pair of parallel support bar means fixed to it on its side adjacent the other leg, wherein each of said pair of parallel support bar means comprises first and second flange portions, wherein the first flange portion of each of said support bar means is situated above and spaced from the second flange portion of the support bar means, wherein the first flange portion of one of said support bar means is directed in a direction generally toward the first flange portion of the other of said support bar means, wherein the second flange portion of one of said support bar means is directed in a direction generally toward the other of said support bar means, wherein said first upwardly facing support surface means comprises said second flange portions of said pair of support bar means, wherein said second downwardly facing support surface means comprises said first flange portions of said pair of support bar means, and wherein the pair of support bar means are joined to each other at least near one of their respective ends by a second transverse member having stop surface means situated in a plane extending transversely of said pair of support bar means and said first and second flange portions of said pair of support bar means.

10. A support element for an elongate board or the like, comprising first upwardly facing support surface means adapted to engage an underside of the board along its end portion, second downwardly facing support surface means parallel to and spaced vertically from the plane of said first supporting surface means by a distance sufficient to accommodate the thickness of the board and effective to engage an upper surface of the board, and at least one ground engaging surface so positioned that in use the support element engages the ground below the first supporting surface means, wherein a pair of legs are joined to each other by a transversely extending member, each of said legs having one of a pair of parallel support bar means fixed to it on its side adjacent the other leg, wherein each of said pair of parallel support bar means comprises first and second flange portions, wherein the first flange portion of each of said support bar means is situated above and spaced from the second flange portion of the support bar means, wherein the first flange portion of one of said support bar means is directed in a direction generally toward the first flange portion of the other of said support bar means, wherein the second flange portion of one of said support bar means is directed in a direction generally toward the other of said support bar means, wherein said first upwardly facing support surface means comprises said second flange portions of said pair of support bar means, wherein said second downwardly facing support surface means comprises said first flange portions of said pair of support bar means, wherein the pair of support bar means are joined to each other at least near one of their respective ends by a second transverse member carrying stop surface means, wherein said stop surface means is situated in a plane generally perpendicular to the pair of support bar means, and wherein said stop surface means is positioned as to have at least a portion thereof at an elevation between said first and second support surface means.

11. A support element according to claim 10 wherein the ends of the legs extend to intersect said plane.

12. A support element according to claim 10 wherein each of said pair of support bar means comprises web means, wherein the web means of each of said pair of support bar means structurally interconnects the first flange portion to the second flange portion thereof, and wherein each of said pair of support bar means is fixedly secured to its adjacent leg by means of said web means.

* * * * *